US007833178B2

(12) United States Patent
Lee et al.

(10) Patent No.: US 7,833,178 B2
(45) Date of Patent: Nov. 16, 2010

(54) HEEL ELONGATOR AND CALF STRETCHER WITH TOE BAR

(75) Inventors: Jay Lee, Richmond (CA); Helen Chen, 6-9880 Parsons Road, Richmond, BC (CA) V7E 1K9

(73) Assignee: Helen Chen, Richmond, British Columbia (CA)

( * ) Notice: Subject to any disclaimer, the term of this patent is extended or adjusted under 35 U.S.C. 154(b) by 960 days.

(21) Appl. No.: 11/699,969

(22) Filed: Jan. 31, 2007

(65) Prior Publication Data

US 2008/0182733 A1 Jul. 31, 2008

(51) Int. Cl.
*A61H 1/02* (2006.01)

(52) U.S. Cl. ..... 601/29; 601/32; 601/33; 601/34; 606/241

(58) Field of Classification Search ..... 602/32, 602/33, 36, 38, 39; 606/241; 601/5, 23, 601/27, 29, 30, 33–35; 482/79, 80
See application file for complete search history.

(56) References Cited

U.S. PATENT DOCUMENTS 2,798,481 A * 7/1957 Matthews ..... 606/241
2,924,214 A * 2/1960 Zak ..... 601/29
2,940,441 A * 6/1960 Demarest et al. ..... 602/32
3,286,709 A * 11/1966 Hoyer et al. ..... 601/24
4,665,899 A * 5/1987 Farris et al. ..... 601/33
4,751,917 A * 6/1988 Ruf ..... 601/34
4,826,158 A 5/1989 Fields, Jr.
5,611,770 A * 3/1997 Tesch ..... 601/34

* cited by examiner

*Primary Examiner*—Danton DeMille
(74) *Attorney, Agent, or Firm*—Birch, Stewart, Kolasch & Birch, LLP

(57) ABSTRACT

A body elongator includes a container in which a heel elongator and a calf stretcher are fixed. The heel elongator has a leg support slide selectively movable for a predetermined distance by a driving mechanism for elongating a user's heels secured to the leg support slide. The calf stretcher has a toe bar supported between and by two carrier posts. The carrier posts, along with the toe bar, can be rotated from a horizontal position to a vertical position with respect to the frame body. When the user's toes are leaned tightly against the toe bar, with heels secured to the leg support slide, making the feet plantar flexion along the movement direction of the leg support slide, the Achilles tendon and the calf muscles groups can be stretched when the leg support slide is driven to move into the container.

7 Claims, 8 Drawing Sheets

HEEL ELONGATOR AND CALF STRETCHER WITH TOE BAR

BACKGROUND OF THE INVENTION

1. Field of the Invention

The present invention relates to a body elongator, and in particular to a body elongator comprising a lower body stretching and elongating structure that can aid to stretch the muscles, providing warm up for exercises, and to prevent muscle cramps. It is convenient for carrying since the two structures can be folded inside a frame.

2. The Prior Arts

Body stretching is mainly to enhance the mobility of the joints, and able to maintain the muscle in a certain length and proper flexibility. Body stretching is required under many circumstances, such as, for example, for the elderly who need to stretch their muscles and tendons, and bones, office workers having to sit for extended durations, people feeling tired because of the body weight stresses exerting on spines, teenagers who wanted to be simulated for additional growth, and patients who need rehabilitation after surgical operations. In addition, body stretching sometimes can be used as a method for warm up of the body before exercising, such as for preventing and alleviating muscle cramps of the track runners, swimmers, and ballet dancers.

At present, irregardless of whether it is the body stretcher sold on the market for physical fitness or the body stretching device provided in hospitals for rehabilitation, they are all bulky and structurally complicated. As an example, U.S. Pat. No. 4,826,158 discloses leg-stretching and exercising equipment, which is one such classic example. This type of equipment has many disadvantages, such as having a complicated structure that is inconvenient for reassembling and disassembling, and thus cannot be easily carried, and are mostly disposed at stationary locations. As a result, in one aspect, the user would require to first have enough perseverance, and to arrange time to do the body stretching at a specified location. Furthermore, the effectiveness of body stretching is negatively affected because of limited usage time. In addition, due to the excessive size of the device, the user may feel intimidated, and refuse to use it. Accordingly, for those who require to do body stretching everyday, a compact and portable body elongator is necessary.

Apart from the above-mentioned drawbacks due to structural complexity, the conventional body stretching equipment only provides a leg stretching function, which has less added value, and is much more uneconomical for manufacturers and consumers alike.

SUMMARY OF THE INVENTION

The present invention is aimed to provide a body elongator, which is easy for assembly, carrying, and storage. A primary objective of the present invention is to prolong a user's physical training session, as well as even being able to perform whole body stretching and calf stretching during sleep for achieving superior results.

Accordingly, a body elongator of the present invention generally comprises three sub-structures and corresponding functionalities, which are described as follows:

(1) A heel elongator structure comprises a leg support slide and a driving mechanism for driving the leg support slide. The driving mechanism comprises a steel cable having an end connected to a flexible rope, which is windable around a reel shaft, and an opposite end connected to the leg support slide whereby winding of the rope around the reel shaft induces movement of the leg support slide on which heels of a user are positionable. Alternatively, the driving mechanism comprises two sets of racks and pinions, in which the racks are fixed to the leg support slide and the pinions are driven by motors so as to convert the rotation of the pinions into back-and-forth linear movement of the leg support slide.

(2) A calf stretching structure comprises a toe bar supported by a pair of carrier posts which are height-adjustable and are pivoted on opposite sidewalls of a container case. The carrier posts can be rotated by hand to move, with respect to the container, from a horizontal position to a vertical position, or alternatively a power driving mechanism is employed to move, via a gear train, the carrier posts and the toe bar supported by the carrier posts between the horizontal and vertical positions. When a user's toes are put tight against the toe bar with heels secured to the leg support slide and with his or her feet in the form of plantar flexion along the movement direction of the leg support slide, the Achilles tendon and the calf muscle groups can be stretched when the leg support slide is actuated, and thereby calf muscle cramps can be prevented.

(3) A convenient carrying structure comprises case having a container to which a two-stage foldable cover is attached by hinges. The case has a size substantially corresponding to a laptop computer. To operate, the cover is unfolded underneath the bottom of the container, serving as a base board stably disposed on a fixture surface, such as a bed, and if desired, the toe bar is moved upward beyond the container. To pack, the toe bar is laid flat back into the container, and the steel cable is wound up, and, together with the driving mechanism, is placed inside the container within a space between the leg support slide and the toe bar, and thus providing easy carrying and storage convenience after the container is closed by the cover.

Comparing with a conventional body stretcher, the present invention has the advantage of being of smaller size and a portable design that can be used anytime and anywhere. Especially, the user can adjust the desired degree of stretching of the muscle groups before sleeping, so as to allow the body to be stretched in a smooth continuous manner, no matter if asleep or awake.

In addition, the structure of the present invention is simple for easy operation and storage. So the users can perform body stretching in a pleasant mood. Besides, two stretchers with different function are provided in one frame, which highly enhances practicability and provides additional value.

BRIEF DESCRIPTION OF THE DRAWINGS

The present invention will be apparent to those skilled in the art by reading the following detailed description of a plurality of embodiments thereof, with reference to the attached drawings, in which.

DETAILED DESCRIPTION OF THE PREFERRED EMBODIMENTS

Figure 1:
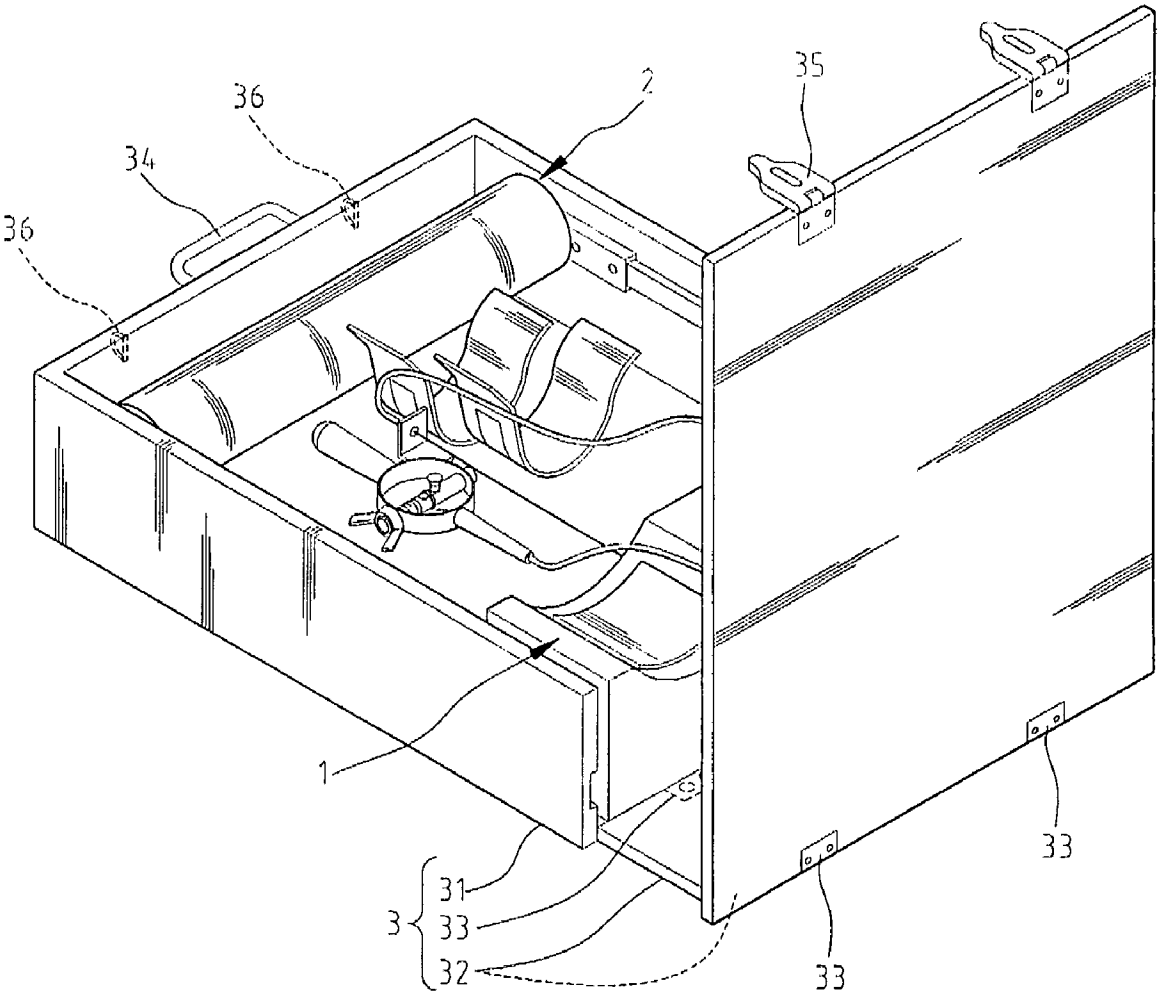
FIG. 1 is a perspective view showing a body elongator constructed in accordance with the present invention in a partially open condition, the body elongator comprising a case in which a heel elongator and a calf stretcher are mounted.

With reference to the drawings and in particular to FIG. 1, a body elongator constructed in accordance with the present invention comprises a case, generally designated with reference numeral 3, in which an accommodation space is defined. The body elongator also comprises a heel elongator 1 and a calf stretcher 2, both being arranged inside the case 3 to make a compact construction that allows for easy carrying and transportation.

The case 3 comprises a container 31 having a suitable size, such as three inches in height, fourteen inches in both length and width, to accommodate the heel elongator 1 and the calf stretcher 2. The container 31 has an open top for a user's access of the heel elongator 1 and the calf stretcher 2 and an open proximal end through which the user's feet may extend for being treated by the heel elongator 1 and the calf stretcher 2.

A cover 32 is attached to the container 31 with hinges 33. The cover 32 is composed of two boards connected with hinges 33 and the two boards are respectively corresponding to the open top and open end of the container 31 for selectively opening and/or closing the open top and open end of the container 31.

Figure 2:
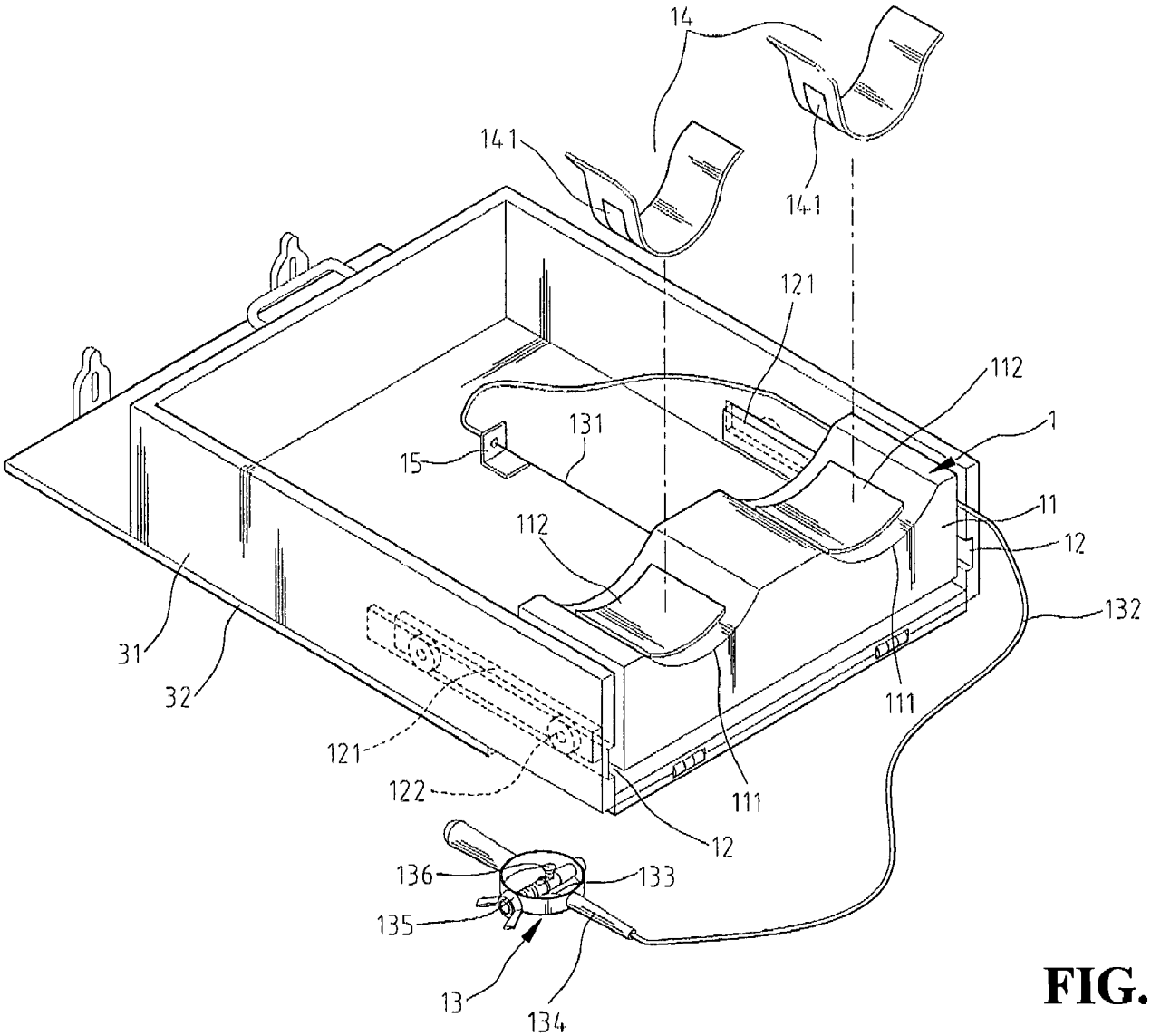
FIG. 2 is a perspective view of the body elongator of the present invention in an open condition, a manually operated driving mechanism being incorporated to selectively move the leg support slide of the heel elongator with respect to the case.

Also referring to FIG. 2, when the case 3 is opened for use, the cover 32 is folded under the bottom of the container 31, serving as a base board and exposing the open end of the container 31, so as not to obstruct the movement of the user's feet. If desired, a handle 34 (see FIG. 8) may be attached to the container for hand carrying. A plurality of engagement snaps 36 (see FIG. 1) is provided on the container 31 on opposite sides of the handle 34. The cover 32 further comprises a snap latch hinge 35 for engaging with the latch, such that the case 3 is secured when the cover 32 is closed to allow for easy carrying and transportation and storage.

Also referring to FIG. 2, the cover 32 is hinged to the container 31 and can be unfolded underneath the bottom of the container 31. The two-board structure allows the cover 32 to expose the open end of the container 31 when the cover 32 is unfolded underneath the bottom of the container and the heel elongator 1 that is arranged inside the container 31 can be seen.

The heel elongator 1 comprises a leg support slide 11 movable in a longitudinal direction of the container 31 and having two lateral ends adjacent to opposite sidewalls of the container 31. Preferably, a one-inch gap is present between the leg support slide 11 and the sidewall of the container 31. Slide guide means comprising a slide rail 12 and a guide bar 121 is provided between each lateral end of the leg support slide 11 and the corresponding sidewall of the container 31 for guiding movement of the leg support slide 11 with respect to the container 31. The guide bar 121 is mounted to the lateral end of the leg support slide 11 and longitudinally extends in a direction into the container 31. Rollers 122 are mounted to the guide bar 121. The slide rail 12 comprises an elongated slot defined in the sidewall of the container 31 and movably receives the rollers of the guide bar 121 to guide longitudinal movement of the leg support slide 11 with respect to the container 31.

The leg support slide 11 further comprises a hook 19 (see FIG. 4A) disposed at a bottom surface thereof, and the container 31 comprises another hook 19 at the surface thereof. A spring 191 has two ends respectively fixed to the hooks 19. An attachment stop 15 is mounted to a bottom surface of the container 31 at a location away from the leg support slide 11.

The leg support slide 11 is of a box-shape, having a top in which two arc recesses 111 are defined to serve as heel rest portions. Leg fastener means is provided in each heel rest portion 111, comprising a first portion 112 fixed in the heel rest portion 111 and a separate second portion 141 that is releasably engageable with the first portion 112 to secure a user's leg therebetween when the leg is positioned in the heel rest portion 111. In the embodiment illustrated, the leg fastener means are made of hook and loop fasteners and the first portion 112 of the leg fastener means comprises a female piece with loops, while the second portion 141 comprises a male piece with hooks. Preferably, the male piece 141 is carried by a fastening band 14.

A driving mechanism is provided for driving the leg support slide 11 with respect to the container 31. In an embodiment, the driving mechanism is a manually operated mechanism, as shown in the embodiment illustrated in FIG. 2. The manually operated driving mechanism, which is generally designated with reference numeral 13 in FIG. 2, comprises a steel cable 131 wrapped by a protective tubular sheath 132. The steel cable 131 has an outer end connected to a flexible rope 133 and an opposite inner end extending through a hole (not labeled) defined in the attachment stop 15 and fixed to the leg support slide 11. The flexible rope 133 is enclosed by a protective tube section 134 and is further wound around a reel shaft 135 that has a wing nut like end portion for hand operation. The reel shaft 135 cooperates with a locking pin 136.

To drive the leg support slide 11, the reel shaft 135 is manually rotated with the wing nut like end portion to wind the flexible rope 133 around the reel shaft 135. This shortens the flexible rope 133 and the steel cable 131 drives the leg support slide 11 toward the attachment stop 15. As a result, the spring 191 is stretched along with the movement of the leg support slide 11.

Figure 3:
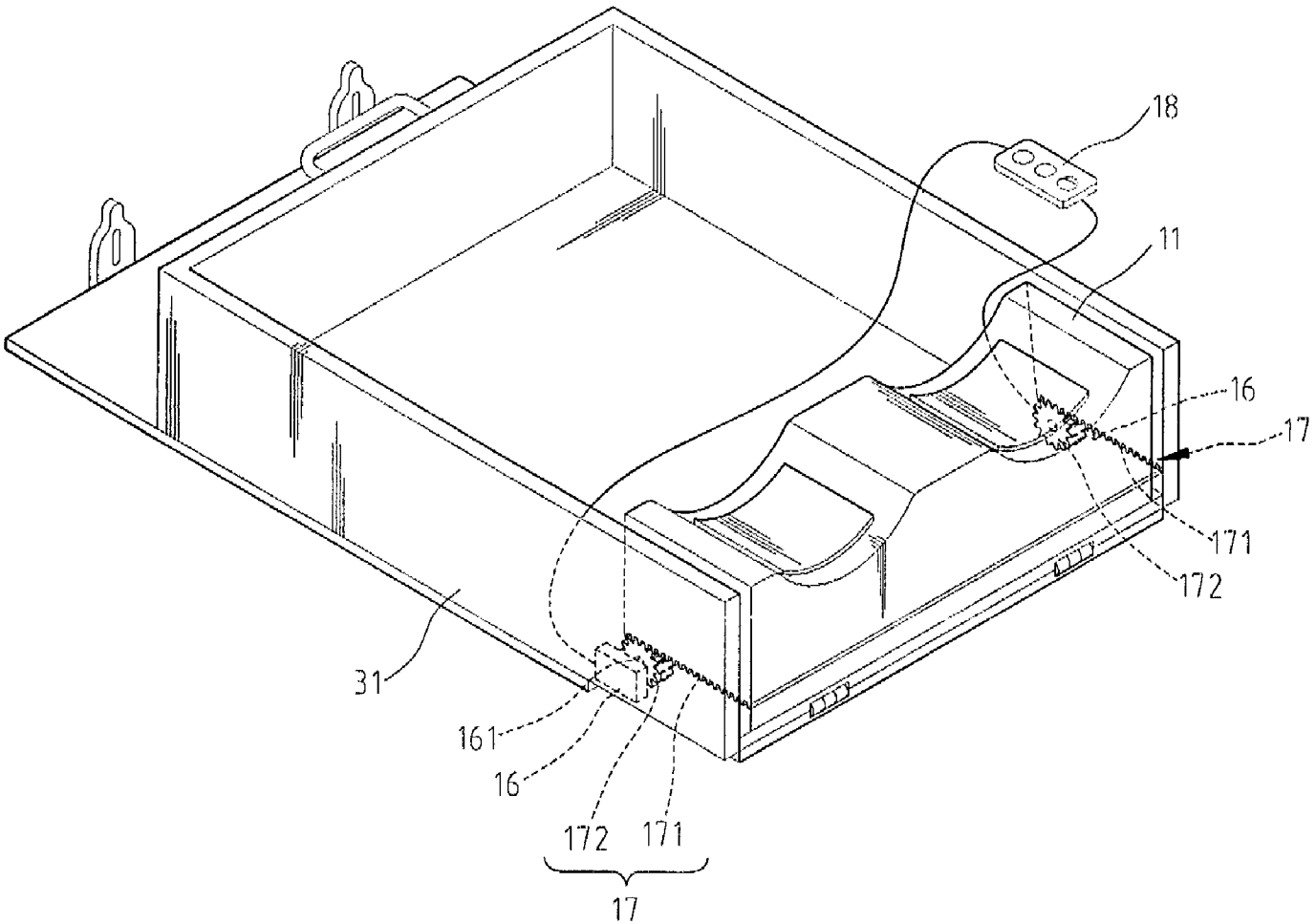
FIG. 3 a perspective view of the body elongator of the present invention in an open condition, a power-operated driving mechanism being incorporated to selectively move the leg support slide of the heel elongator with respect to the case.

Alternatively, the driving mechanism can be a power device. FIG. 3 shows a power-operated driving mechanism in accordance with another embodiment of the present invention, which comprises two motors 16 and two sets of racks and pinions 17, which are preferably of the same specifications. The motors 16 are fixed to the container 31 and have spindles 161 carrying the pinions 172 respectively. The racks 171 are fixed to the leg support slide 11, preferably at a bottom surface of the leg support slide 11, and are engageable with the pinions 172. When the motors 16 are in operation, the pinions 172 are rotated in either forward and reverse directions to move the racks 171 and thus the leg support slide 11 forward or backward inside the container 3. The moving distance of the leg support slide 11 is limited to the length of the rack 171.

Figure 4A:
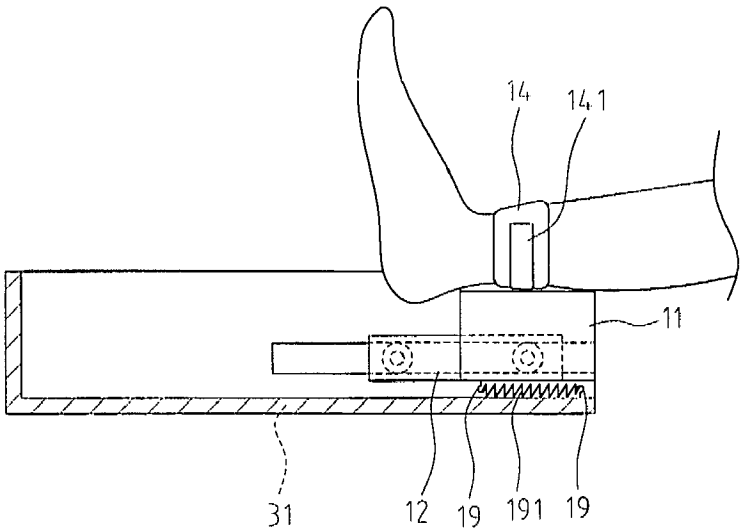
FIGS. 4A and 4B are cross-sectional views of the body elongator of the present invention, demonstrating the operation of the heel elongator in elongating the heels of a user.
Figure 4B:
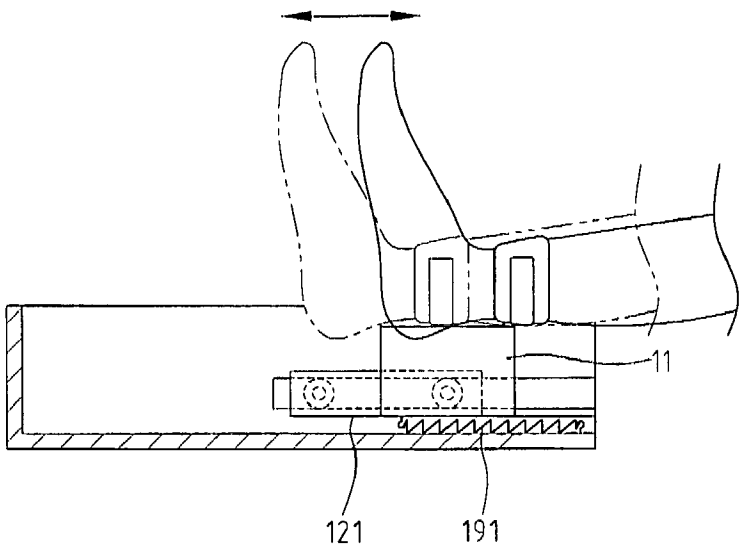

Referring to FIGS. 2, 4A and 4B, elongating the heel or body of a user with the heel elongator 1 is realized by longitudinally moving the leg support slide 11 with respect to the case 3, which in operation, is made stationary by placing on a fixture surface, with the driving mechanism 13. Legs of the user are put into the case 3 with the ankle resting in the recesses 111 and secured by the leg fastener means. In the embodiment illustrated, the male pieces 141 of the fastening bands 14 is put in engagement with the female pieces 112 to tightly secure the ankles to the leg support slide 11. The reel rotating shaft 135 is then manually rotated to wind the flexible rope 133 thereon, thereby pulling the steel cable 131 to drive the leg support slide 11 longitudinally. With the linear movement of the leg support slide 11, heels secure to the leg support slide 11 are thus stretched (FIG. 4B shows the legs after stretching). When the leg support slide 11 is moved to a desired position, the locking pin 136 is put into a positioning hole (not labeled) defined in the reel shaft 135 to secure the reel shaft 135 and thus fixing the leg support slide 11 in said desired position with respect to the case 3. At this time, the spring 191 is stretched.

To terminate the leg stretching, the locking pin 136 is released, and the leg support slide 11 is then returned to the original, un-stretched position by the springing force of the spring 191. Alternatively, the legs can be simply released and lifted by separating the male pieces 141 from the female pieces 112.

Referring to FIG. 3, the power-operated driving mechanism comprises a switch 18 for controlling the actuation of the motors 16. Thus, the user, once having his or her ankles secured to the leg support slide 11, operates the switch 18 to actuate the motors 16 for inducing movement of the leg support slide 11 to the desired position to effect elongation of heels.

Figure 5:
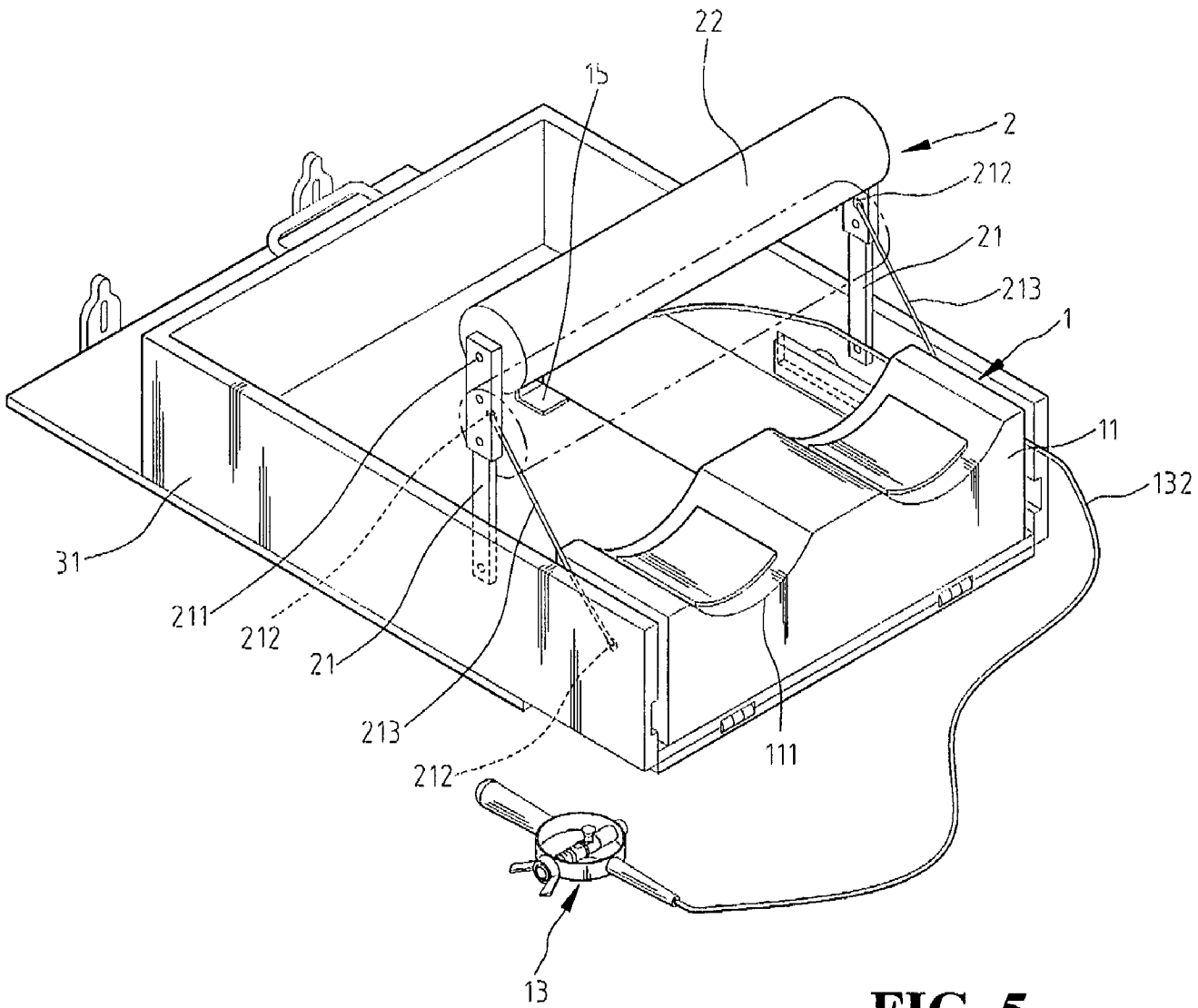
FIG. 5 is a perspective view of the body elongator of the present invention, illustrating a manually operated calf stretcher in accordance with the present invention.

With reference to FIG. 5, besides the heel elongator 1, the body elongator in accordance with the present invention additionally comprises a calf stretcher 2 arranged in the container 31 of the case 3.

The calf stretcher 2 comprises a toe bar 22, having a diameter of about 4 centimeters, rotatably supported by two carrier posts 21 located on opposite ends of the toe bar 22. A plurality of aligned holes 211 is defined in and distributed along the carrier posts 21 to selectively engage the ends of the toe bar 22 for adjusting the height of the toe bar 22 with respect to the container 31. The carrier posts 21 are pivotally coupled to the sidewalls of the container 31 to allow the carrier posts 21 to rotate between a horizontal stowed position inside the container 31 and a vertical erected position. Two hook rings 212 are respectively provided on the carrier posts 21 and the sidewalls of the container 31. When the toe bar 22 is rotated to the vertical position with respect to the container 31, a supporting rod 213 with hooks disposed at opposite ends thereof is provided to secure the toe bar 22 at the vertical position by clasping the hooks with the hook rings 212.

To stow the calf stretcher 2 when it is not in use, the carrier posts 21, together with the toe bar 22, is rotated to the horizontal position to bring the toe bar 22 back into the container 31, preferably at a location opposite to the leg support slide 11. When the calf stretcher 2 is called upon for use, the bar 22 is manually rotated with the pivotal joint of the carrier posts 21 with the case 3 as rotation center from the horizontal position to the vertical position along a circular path.

Figure 6:
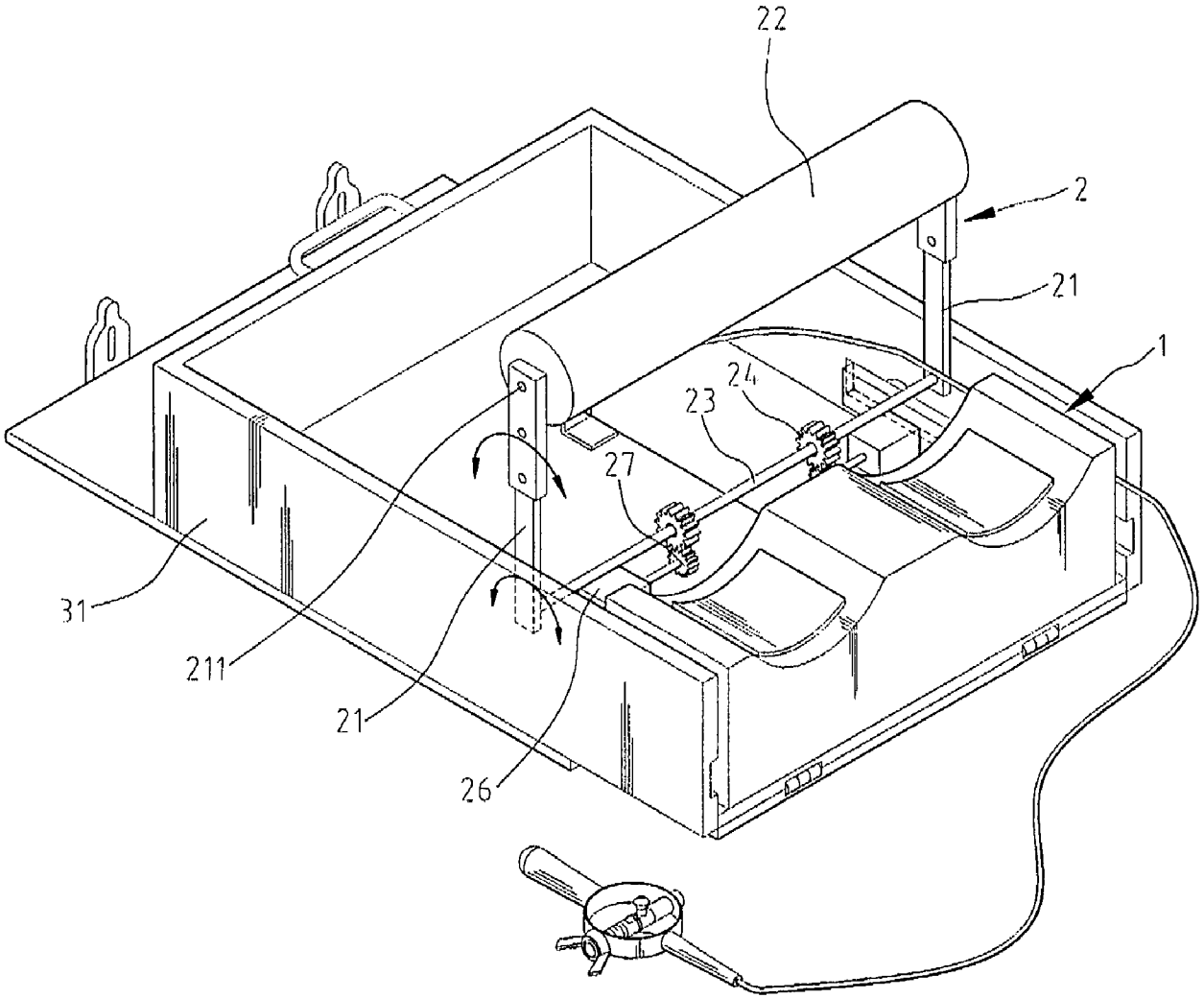
FIG. 6 is a perspective view of the body elongator of the present invention, illustrating a power-operated calf stretcher in accordance with the present invention.

Alternatively, as shown in FIG. 6, the toe bar 22 can be of power driving to move from the horizontal position to the vertical position. The power driving of the toe bar 22 is realized by a power driving mechanism comprising a long shaft 23 extending between and connected to the carrier posts 21 that are pivoted to the sidewalls of the container 31. Two first gears 24 are mounted to the long shaft 23. The two first gears 24 are preferably identical and spaced from each other by a proper distance. The driving mechanism further comprises two motors 26 fixed in the container 31 of the case 3. Each motor 26 has a spindle (not labeled) to which a second gear 27 is mounted and engageable with the respective first gear 24. When the motors 26 are actuated, the second gears 27 are rotated either forward or backward and drive the mated first gears 24 to induce rotation of the long shaft 23, together with the carrier posts 21 and the toe bar 22 attached to the long shaft 23, about the pivotal joint of the carrier posts 21 with the sidewalls of the container 31. To control the rotational angular range of the carrier posts 21 and the toe bar 22, the number of rotations of the gears 27 (or 24) is set in advance, or alternatively, a limit switch (not shown) is applied, such that the toe bar 22 can move repeatedly within the predetermined angle.

Figure 7:
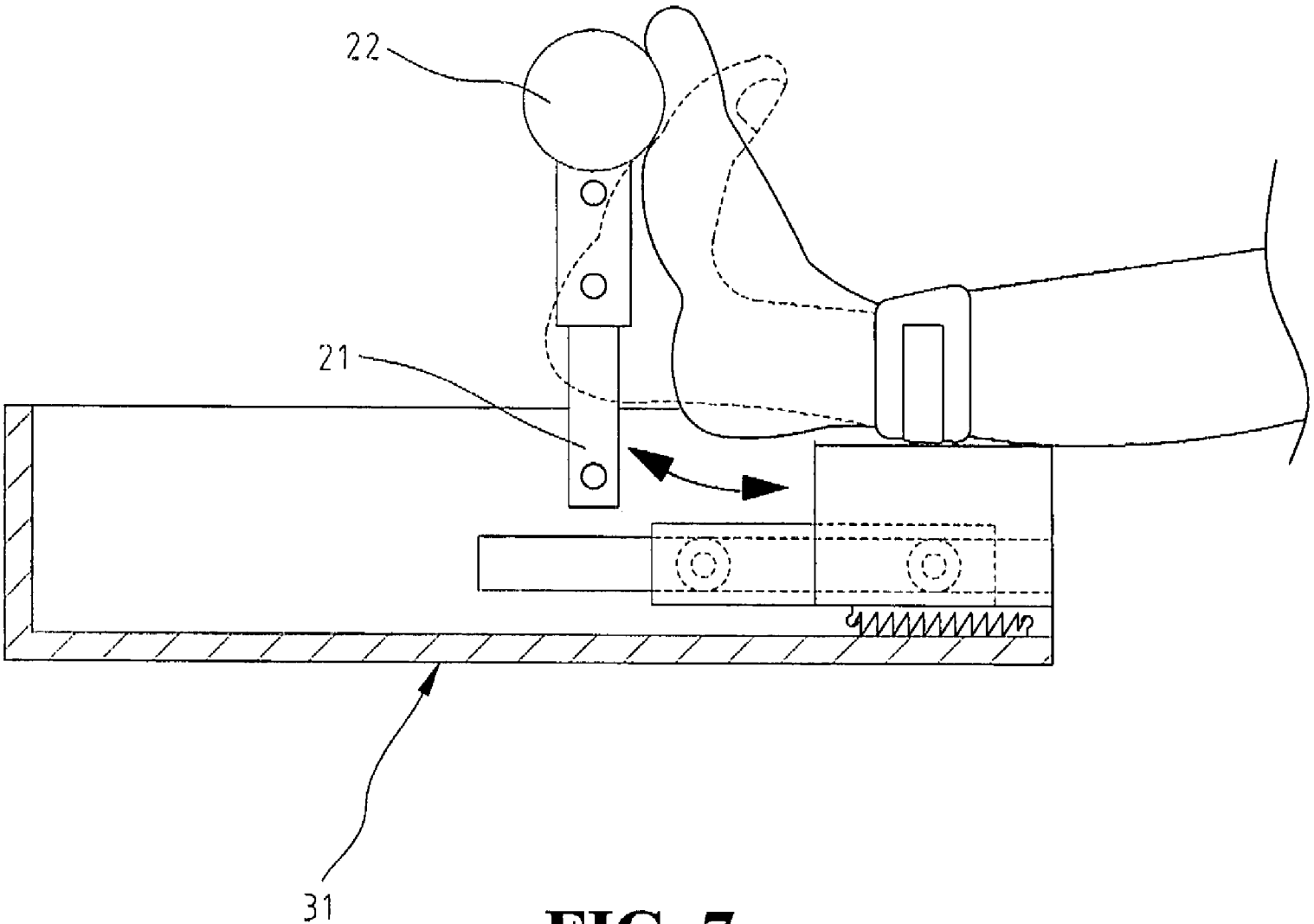
FIG. 7 is a cross-sectional view of the body elongator of the present invention, demonstrating the operation of the calf stretcher in stretching the calf of a user.

Referring to FIG. 7, to operate the calf stretcher 2, the carrier posts 21 are moved, either manually or by power, from the horizontal position to the vertical position, by rotating about the pivotal joint of the carrier posts 21 to the container 31. To stabilize and provide support for the carrier posts 21 when the user's toes are placed on the toe bar 22, the supporting rod 213 is employed by clasping the two hooks of the supporting rod 213 with the hook rings 212 on the two carrier posts 21 and on the frame body 31, respectively. When a user lies on his or her back on a horizontal surface, preferably in the bed, with the toes tightly leaning against the toe bar 22 and the heel secured on the leg support slide 11 making the feet exhibit plantar flexion along the movement direction of the leg support slide 11, by actuating the leg support slide 11 to gently pull down on the user's leg, the Achilles tendon and the calf muscles groups can thus be stretched to prevent the calf cramps.

Figure 8:
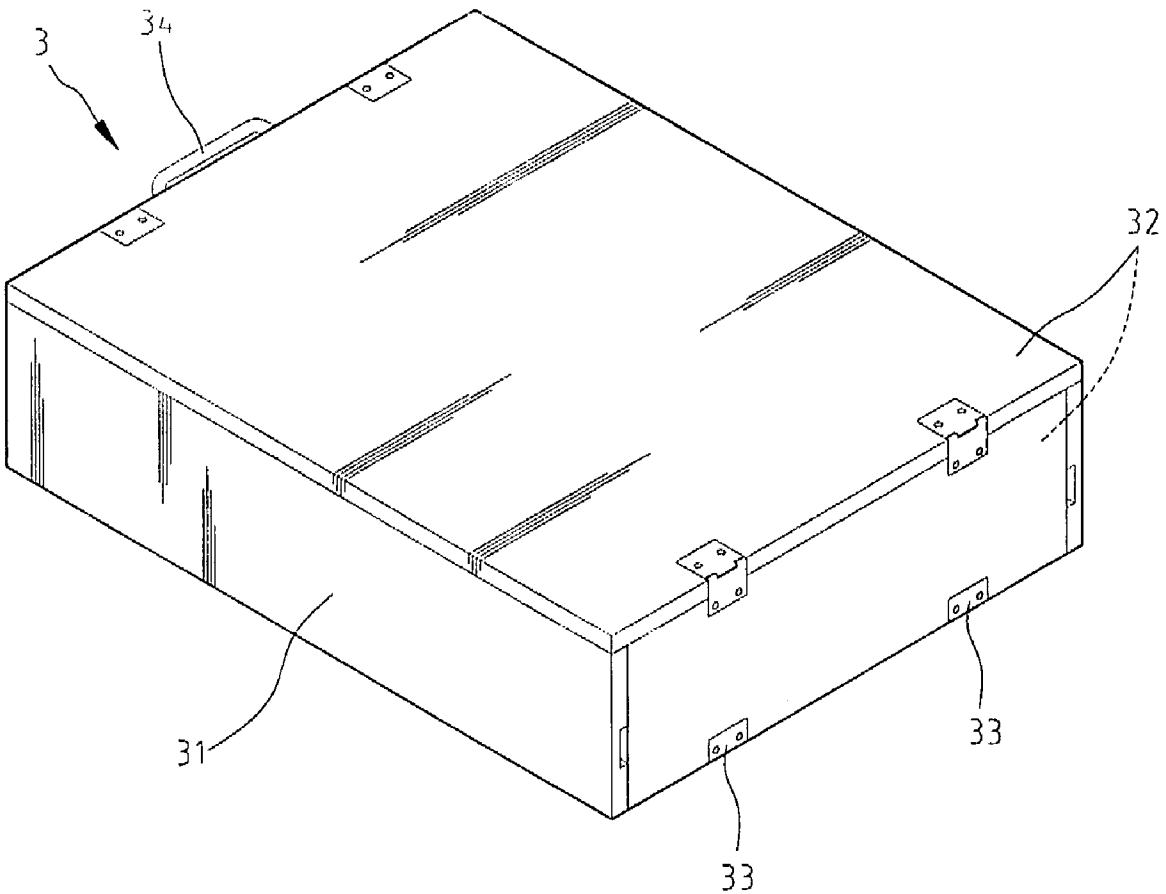
FIG. 8 is a perspective view of the body elongator in a closed condition for carrying by a user's hand.

After use, the toe bar 22 is moved back into the container 31 of the case 3. In addition, the steel cable 131 and the driving mechanism 13 are put back into the container 31 at a location between the leg support slide 11 and the toe bar 22. The cover 32 is put on the container 31 to close the case 3 and the whole device can be conveniently carried and stored, as illustrated in FIG. 8.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A body elongator, comprising:

a case comprising a container having an open top and an open end closable by a cover;

a heel elongator disposed inside the container and comprising a leg support slide movably mounted in the container and a driving mechanism for driving the leg support slide to move with respect to the container; and a calf stretcher disposed inside the container and comprising a toe bar supported by carrier posts connected to opposite ends of the toe bar, the carrier posts being mounted to the container to selectively move between a horizontal position and a vertical position with respect to the container, wherein the carrier posts form a plurality of holes to selectively engage the ends of the toe bar for adjusting location of the toe bar with respect to the container, and the calf stretcher comprises a long shaft extending between and fixed to the carrier posts, two first gears mounted to the long shaft, and two motors mounted to the container and driving two second gears engaging the first gears respectively, whereby operation of the motors selectively move the bar supported by the carrier posts between the horizontal and vertical positions through the engagement between the first and second gears and the long shaft mounted to the carrier posts.

2. The body elongator as claimed in claim 1, wherein the cover comprises two boards hinged together for closing the open top and the open end of the container respectively, and wherein the cover is hinged to the container, whereby the cover is positionable underneath a bottom of the container.

3. The body elongator as claimed in claim 1, wherein the leg support slide is of a box-shape having a top defining arc recesses serving as heel rest portions, leg fastener means being provided on the heel rest portions and comprising a first portion fixed in each heel rest portion and a counterpart second portion engageable with the first portion for selectively securing ankles of a user in the heel rest portions.

4. The body elongator as claimed in claim 3, wherein the leg fastener means comprises hook and loop fastener having a female piece with loops fixed in the heel rest portion and a male portion with hooks attached to a fastening band.

5. The body elongator as claimed in claim 3, wherein the leg support slide has two ends opposing sidewalls of the containers, a slide rail being formed in each sidewall of the container, a guide bar mounted to each end of the leg support slide and carrying at least one roller movably received in the slide rail whereby the leg support slide is movable with respect to the container with the roller moves along the slide rail.

6. The body elongator as claimed in claim 5, wherein the driving mechanism comprising a steel cable having an end connected to a flexible rope windable around a reel shaft and an opposite end extending through a hole defined in a stop mounted to the container and connected to the leg support slide.

7. The body elongator as claimed in claim 3, wherein the driving mechanism comprises two racks mounted to the leg support slide and two pinions engageable with the racks, two motors being mounted in the container to drive the pinions for moving the leg support slide through the engagement between the pinions and the racks.

* * * * *